United States Patent [19]

Wimmershoff-Caplan

[11] Patent Number: 4,674,298

[45] Date of Patent: Jun. 23, 1987

[54] PENDANT NECKLACE ASSEMBLY INCLUDING A DISENGAGEABLE WRITING IMPLEMENT

[76] Inventor: Sue Wimmershoff-Caplan, 250 W. 94th St., New York, N.Y. 10025

[21] Appl. No.: 713,010

[22] Filed: Mar. 18, 1985

[51] Int. Cl.[4] ..... A44C 25/00

[52] U.S. Cl. ..... 63/1 A; 24/10 R; 24/3 B; 224/202; 224/251

[58] Field of Search ..... 63/1 R, 2, 4, 3, 1 A; 24/3 A, 3 E, 3 H, 115 R, 11 HC, 11 CT, 11 R, 12, 3 B, 10 R; 224/191, 202, 251, 219

[56] References Cited

U.S. PATENT DOCUMENTS

| | | | |
|---|---|---|---|
| 816,997 | 4/1906 | Pollard | 63/28 |
| 1,506,207 | 8/1924 | Wahl | 24/10 R |
| 2,194,379 | 3/1940 | Bicks | 63/2 |
| 2,285,000 | 6/1942 | Wallace | 24/10 R |
| 2,346,870 | 4/1944 | Post | 24/3 E |

FOREIGN PATENT DOCUMENTS

| | | | |
|---|---|---|---|
| 88934 | 8/1921 | Switzerland | 24/3 A |
| 12253 | of 1903 | United Kingdom | 63/1 R |
| 20427 | of 1914 | United Kingdom | 24/10 R |

*Primary Examiner*—Richard J. Johnson

[57] ABSTRACT

An assembly including a pen (or other writing implement) having a cap is designed so that the pen can be worn as part of an ornamental necklace. In particular, the assembly has a precious metal ring portion into which the cap of a writing implement such as a fountain pen can be slidably engaged or fitted, and the assembly also has a precious metal mounting portion joined to the ring portion by means of a precious metal connector portion, as well as has a pair of precious metal loops attached to opposite sides of the outer surface of the ring. Opposite extreme ends of a chain are fastened into these loops, and an ornamental decoration of ornamental stone(s) or other ornamental piece is mounted in the mounting position.

18 Claims, 9 Drawing Figures

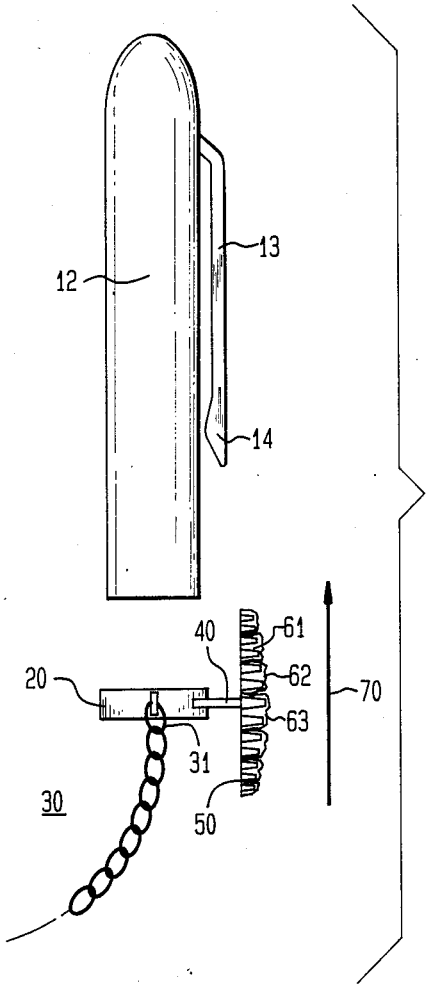
FIG. 7
FIG. 8
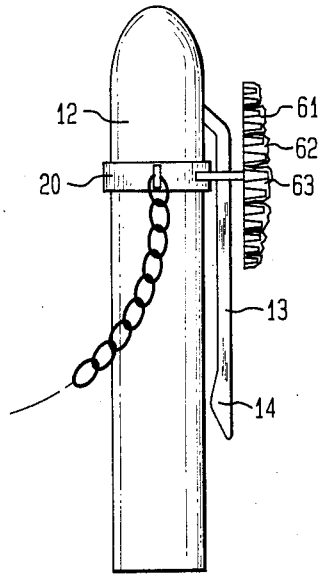

PENDANT NECKLACE ASSEMBLY INCLUDING A DISENGAGEABLE WRITING IMPLEMENT

FIELD OF THE INVENTION

This invention relates to necklace arrangements for carrying objects like writing implements having disengageable caps, such as pens.

BACKGROUND OF INVENTION

Women entering the business and professional scenes have encountered problems in having pens or other writing implements that are both easily and quickly available as well as attractive. For stylistic reasons, women's clothing is not designed with pockets for wearing pens as men do by using a pen cap having a clip to engage firmly the surfaces of their pockets. Moreoever, women's purses tend to swallow up any such implements, so that awkward fumbling is required in order to retrieve them. Moreover, cheap pens won't do: women professionals and executives are cautioned by executive dress experts to use tasteful and elegant writing implements.

In the prior art, there have been very inexpensive pendant pen assemblies, such as a pen comprising a pen body and pen cap with a chain mechanically fastened to the cap through an aperture formed in the top of the cap during manufacture. However, such a pen assembly is unsuitable for wearing as a necklace by executive business and professional women, because it is not very attractive. Also, the prior-art pen, being cheap, does not write well or reliably. Even if such a pen assembly would be made with a well constructed pen, the chain would not be a suitable business executive ornament unless it would be made of fine jewelry quality precious metal such as gold, silver or platinum. However, there appears to be no feasible way in prior art to decorate such a pen assembly as by decorating the assembly with a fine jewelry quality ornament of precious metal or with an ornamental jewel (or jewels) or other ornamental element(s) mounted on a precious metal mounting element (or frame).

The problem then is to provide a reliable, stable, and good-looking pen assembly to be worn as a necklace.

There are problems associated with providing such a pen assembly.

Good quality pens and caps on the market are generally not made of solid gold, silver or platinum. Those which are made of such precious metals are extremely expensive, and also tend to be unduly heavy in weight.

However, the metal used in any decoration is desirably made of precious malleable metal(s)—such as gold, silver or platinum—both for reasons of strength and attractiveness, and also because a non-precious (non-malleable) metal cannot be worked to reliably hold such jewel(s) or other ornamental element(s) desired for further decorative purposes. However, there appears to be no feasible way to bond a precious metal chain directly to a non-precious metal pen in such a way that the bond will be durable and attractive enough to wear as a necklace.

SUMMARY OF INVENTION

This invention solves these problems and provides an assembly in which a writing implement is carried as a part of a necklace; and an ornamental decoration may also be simultaneously carried in the assembly. More specifically the assembly comprises a ring portion of precious metal, a pair of loops of precious metal being located on opposing sides of the outer surface of the ring portion, and a chain having a pair of extreme links each of which is linked to a different one of the loops, so that the ring portion is thus attached to the chain. For decorative purposes, there are added to the assembly a connector portion of precious metal located on the outside surface of the ring portion, advantageously located symmetrically between the loops, and a mounting portion of precious metal located on the connector portion, so that a decorative stone or set of stones, or other ornamental decoration can be mounted in the mounting portion or be formed as a part thereof. The ring portion, while thus attached to the chain, can then be slidably engaged on the cap of a pen (or other writing implement) preferably fitting snugly underneath the clip of the cap. The body of the pen itself can then at will be engaged in and disengaged from the cap as desired for carrying and writing. The cap is advantageously plated with or filled with precious metal, for decorative purposes. The assembly, including the pen body engaged in the cap, can then be worn as a necklace in which the pen with the ornamental decoration lies stably and attractively on the wearer's chest. If desired, the pen cap with pen body engaged therein can also be clipped to a front edge of a jacket or blouse while the chain is still being worn around the wearer's neck for greater security against accidental loss. While the chain of the assembly is still strung around the wearer's neck, the pen body can be quickly disengaged from the cap for use in writing.

BRIEF DESCRIPTION OF THE DRAWINGS

This invention together with its features and advantages can be better understood from the following detailed description when read in conjunction with the drawings in which

FIG. 7 is a side view of the specific embodiment of the invention in the process of being assembled with a pen cap;

FIG. 8 is the same view of the invention as FIG. 7 after the process of being assembled with the pen cap has been completed.

All drawings are only approximately to scale.

DETAILED DESCRIPTION

Figure 1:
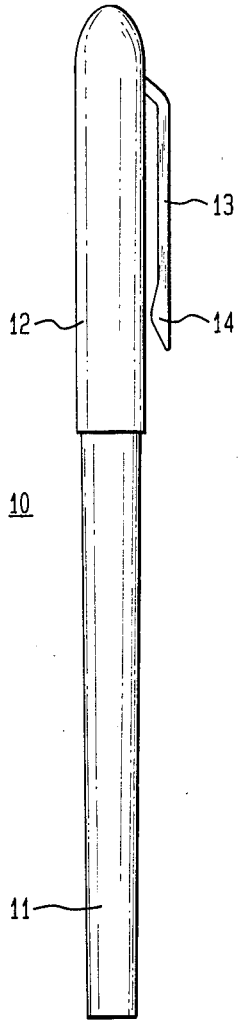
FIG. 1 (PRIOR ART)
FIG. 1 is a side view of a commonly used pen body and pen cap.

FIG. 1 shows a commonly available pen 10 including a pen body 11 and a pen cap member 12 to which is attached a clip 13. Typically the clip has a relatively thick bottom portion 14. In a preferred embodiment, the pen body 11 can be disengaged from the tightly fitted cap 12 by pulling rather than by screwing them apart.

Moreover the pen 10 is preferable gold plated or gold filled, but it not essential that the material of the pen 10 be plated or filled with any precious metal, but the surface of the pen 10 should advantageously be aesthetically attractive as known in the art. It is this pen 10 that is to be used in the inventive ornamental necklace assembly illustrated in FIG. 9. Illustratively this pen is the "Montblanc Quickpen" sold by the Montblanc firm of Germany (not shown).

Figure 2:
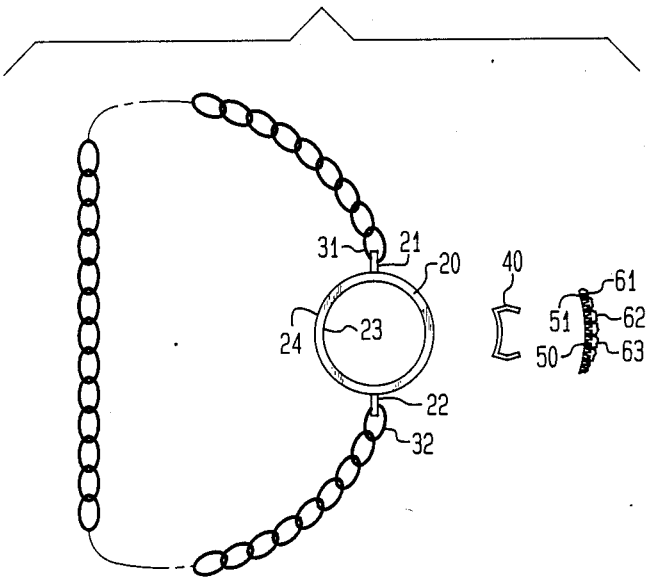
FIG. 2 is a top view of portions of a specific embodiment of the invention at an early stage of its manufacture in an exemplary method for such manufacture.

FIG. 2 shows separate parts of a chain 30 with its two extreme links 31 and 32 respectively linked to loops 21 and 22 respectively located on opposite sides of the outer circumferential surface 24 of a ring portion 20. The ring 20 has an inner circumferential surface 23. FIG. 2 also shows a mounting portion 50 having a plurality of prongs, illustratively a prong 51, and a plurality of ornamental gems or stones, illustratively diamond and/or ruby stones 61, 62, 63, etc. The stones are mounted and set in, and held firmly in place by, the prongs of the mounting portion 50, as known in the jewelry art. Finally, FIG. 2 further shows a separate connector portion 40 which has a U-shaped configuration, except that the bottom of this U (i.e., the left-hand surface of the connector portion 40 as illustrated in FIG. 2) is of opposite curvature from that of the ordinary U-shape. Advantageously this curvature is of substantially the same magnitude as that of the outer surface 24 of the ring 20, for better mutual bonding as described more fully below. Typically, the cross section of the connector portion is approximately circular throughout, but this is not essential. Advantageously, the ring portion 20, the chain 30 (including its extreme links), the connector portion 40, and the mounting portion 50 (including its prongs) are all made of solid gold or other precious metal (although not necessarily the same metal for each). It is particularly important that the mounting portion be made of a malleable metal so that the stones can be reliably set and held firmly in place, as known in the jewelry art.

Figure 3:
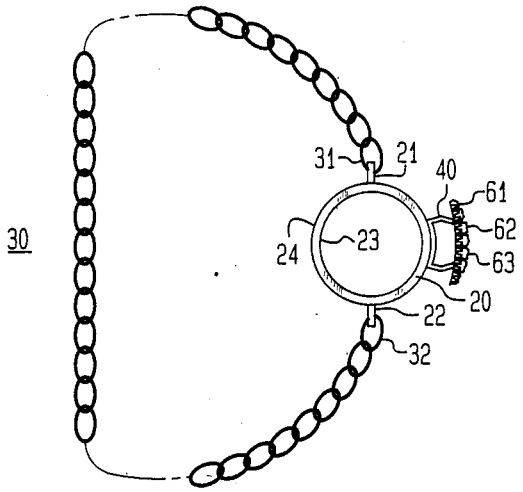
FIG. 3 is a top view of the portions illustrated in FIG. 2 as joined together into an integral structure at a subsequent stage of such manufacture.
Figure 4:
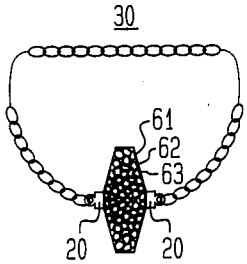
FIG. 4 is a front view of the portions illustrated in FIG. 3.
Figure 5:
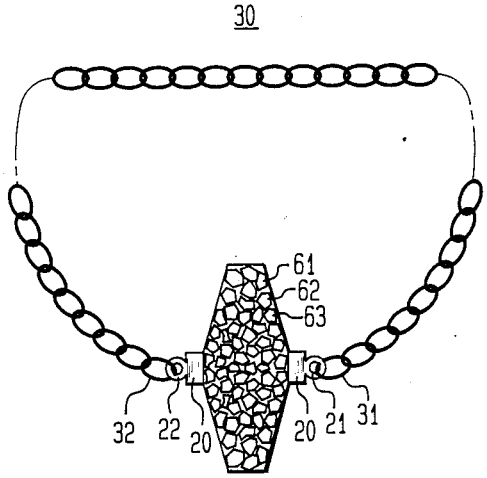
FIG. 5 is the same view of FIG. 4 somewhat enlarged for better appreciation of the invention.
Figure 6:
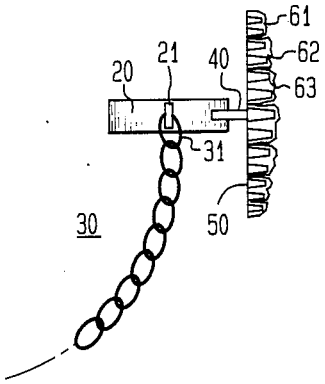
FIG. 6 is a sideview of FIG. 4.

As indicated in FIG. 3, the connector portion 40 is permanently joined to the ring portion 20, as by thermal bonding under suitable pressure or other method of welding or fusing as known in the jewelry art; and the connector portion 40 is similarly permanently joined to the mounting portion 50 so that the connector portion is located symmetrically (equidistant) with respect to the loops 21 and 22. It should be understood, of course, that the order of sequence of joining the various portions can be varied and that the various portions can be joined or made together in a variety of ways to provide a firmly integrated structure. For example, the extreme links 31 and 32 of the chain 30 can be linked to the loops 21 and 22 subsequent to joining the connector portion 40 to the ring portion 20 and/or to the mounting portion 50. Subsequent to all such joinings, the integrated structure as thus manufactured appears as shown in FIG. 3 (top view), FIG. 4 (front view), and FIG. 6 (side view). FIG. 5 simply shows the same (front) view as FIG. 4 but is enlarged for clearer viewing and appreciation of the thus integrated structure.

Figure 9:
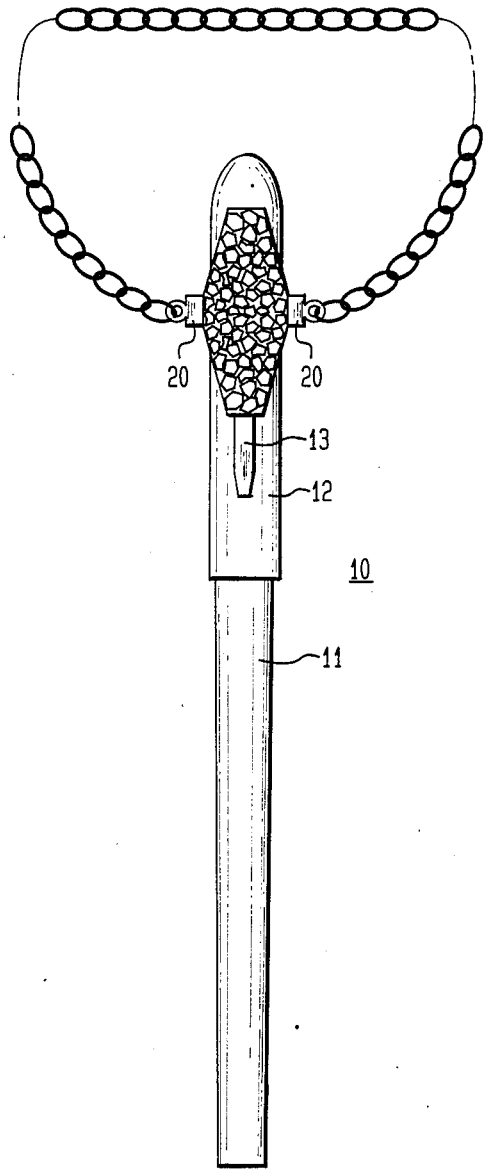
FIG. 9 is a front view of an ornamental necklace assembly, in accordance with the specific embodiment of the invention, after a detachable pen body has been engaged in the pen cap.

As indicated in FIGS. 7 and 8, the thus integrated structure is assembled into the pen cap 12, by sliding the ring onto the cap. An arrow 70 in FIG. 7 simply indicates a motion of the ring portion 20—together with the chain 30, the connector portion 40, and the mounting portion 50 (with the stones 61, 62, 63, etc., set therein)—so that the inner surface 23 (FIG. 3) of the ring portion 20 slides along the outer surface of the cap 12 and simultaneously the pen clip 13 thereby slides between the connector portion 40 and the mounting portion 50, resulting in the assembly which appears as shown in FIG. 8 (side view). Advantageously, therefore, the inner radius of the ring portion 20 is slightly larger (typically by about a millimeter or less) than the radius of the outside surface of the cap everywhere along the cap where it is desired for the ring to slide into position. By engaging the pen body 11 into the cap 12, the resulting necklace assembly appears as shown in FIG. 9 (front view) and can be worn as a necklace with the pen either resting on the wearer's chest or clipped on an edge of the wearer's clothing.

Note that when thus being worn or otherwise used or set aside on a table, for example, the thickened portion 14 of the clip 13 at the bottom thereof prevents the ring portion 20 from accidentally sliding off the cap 12, since it requires a considerable amount of pulling force (and a precise simultaneous adjustment of the bottom tip of the clip relative to the cap, owing to the thick portion 14 of the clip) to remove the ring portion 20 from the cap. Note also that when the assembly is being worn as a necklace the ring portion 20 may not and need not go all the way to the top of the clip 13 but may be prevented from doing so and may thus (as shown) sit at a lower position on the cap 12 by reason of either a thickened or widened portion of the clip 13 near its top, or by reason of the clip 13 being located closer to the cap near the top of the clip than elsewhere, or by reason of the radius of the cap 12 being larger near its top. At any rate the connector portion 40 should be of sufficient size to loop around the clip 13 (except perhaps near its top) and thereby fit slidably thereon. At the position of the clip 13 alongside where the ring 20 surrounds the cap 12, the connector portion 40 and part of the mounting portion 50 together form a closed loop region through which the clip 13 fits.

Although the invention has been described in detail in terms of a specfic embodiment, various modifications can be made without departing from the scope of the invention. For example, the ornamental stones can be mounted in a setting which slides tightly onto the mounting portion so that the ornamental stones can be easily changed by the wearer at will. The chain itself need not be solid precious metal, at some risk of breakage and loss of attractiveness, however. Also if desired, the ornamental stones can be replaced by an ornamental metal or other decoration attached to, or formed as an integral part of, the mounting portion 50. Of course the connector portion 40 together with the mounting portion 50 can be omitted entirely in case no decoration (other than the chain) is desired, at great sacrifice of attractiveness, however. Also, the clip can be omitted while the cap has a thickened portion for holding the ring portion in place.

What is claimed is:

1. A combination device for enabling a person to wear an elongated object comprising (a) a ring portion made essentially of solid precious metal and having a pair of loops made essentially of solid precious metal, the loops being attached to said ring portion on substantially opposing sides of the outer surface thereof, the inner surface thereof being adapted for receiving a first elongated portion of the object so that said first portion can be slidably engaged through the ring in a direction parallel to the axis of the ring;

(b) means for carrying the ring by the person, including a chain having its extreme links each linked to a different one of the loops of the ring portion;

(c) a connector portion attached to said ring portion, the connector portion being made essentially of solid precious metal and being located on the outer surface of the ring portion substantially symmetrically between the loops; and (d) a mounting portion made essentially of solid precious metal joined to the connector portion to form a loop means adapted to receive a second portion of the object, the mounting portion adapted to receive an ornament.

2. The combination of claim 1 in which the first elongated portion of the object is in the form of a cap member on whose outer surface the inner surface of the ring portion is slidably engaged, said cap member including means for detachably engaging thereto a third portion of said object.

3. The combination of claim 1 in which the ring, loops, connector portion, and mounting portion are all made of essentially the same precious metal.

4. The combination of claim 3 in which the precious metal is essentially gold.

5. The combination of claim 1 further comprising ornamental stones set in the mounting portion.

6. The combination of claim 2 in which the second portion of the object is in the form of a retaining clip attached to the cap member.

7. The combination of claim 6 in which the third portion is in the form of a writing implement engaged in the cap member, the implement being detachable from the cap for normal use of the implement while the chain is strung around the person's neck with the cap pendant therefrom by the ring portion.

8. The combination of claim 7 in which the writing implement is a pen.

9. The combination of claim 8 further comprising one or more oramental stones set in the mounting portion.

10. The combination of claim 9 in which the mounting portion has prongs for setting and holding the stones.

11. The combination of claim 7 further comprising one or more ornamental stones set in the mounting portion.

12. The combination of claim 11 in which the mounting portion has prongs for setting and holding the stones.

13. The combination of claim 11 in which the cap is plated or filled with the same precious metal as that of which the ring portion is made.

14. An ornamental pendant necklace assembly comprising (a) a ring portion having an inner and an outer circumferential surface, the inner surface thereof being adapted for enabling a first elongated portion of an object to be slidably engaged through the ring in a direction parallel to the axis of the ring;

(b) first and second loops respectively attached to and extending from substantially mutually opposed first and second sides of the outer surface of the ring portion;

(c) a chain whose first extreme link is linked to the first loop and whose second extreme link is linked to the second loop;

(d) a connector portion secured to the outer surface of the ring portion; and (e) a mounting portion joined to the connector portion, whereby the connector portion and part of the mounting portion form a closed loop means adapted to receive a second elongated portion of the object, the ring, the loops, the chain, the connector portion and the mounting portion each being formed substantially exclusively of precious metals.

15. The assembly of claim 14 in which the first elongated portion of the object is a cap member on whose outside surface the inner surface of the ring portion is slidably engaged, said cap member including means for detachably connecting thereto a third portion of the object.

16. The assembly of claim 15 in which the second elongated portion of the object is a retaining clip permanently attached to the cap member.

17. The assembly of claim 14 further comprising one or more ornamental stones set in prongs of the mounting portions.

18. The assembly of claim 14 in which the precious metals are essentially the same for the ring portion, loops, chain, connector portion, and mounting portion.

* * * * *